US007434952B1

(12) United States Patent
Wang

(10) Patent No.: US 7,434,952 B1
(45) Date of Patent: Oct. 14, 2008

(54) ILLUMINATED DRIVER HEAD WITH CONTROL MEMBER

(76) Inventor: Shyh-Ming Wang, No. 22, Lane 427, Dasheng Street, Taichung City 408 (TW)

( * ) Notice: Subject to any disclaimer, the term of this patent is extended or adjusted under 35 U.S.C. 154(b) by 127 days.

(21) Appl. No.: 11/645,347

(22) Filed: Dec. 26, 2006

(51) Int. Cl.
*B25B 23/18* (2006.01)

(52) U.S. Cl. ..... 362/119; 362/120; 362/203; 362/205; 362/206; 362/208

(58) Field of Classification Search ..... 362/119, 362/120, 203, 205, 206, 208; 81/121.1–125.1; 279/9.1
See application file for complete search history.

(56) References Cited

U.S. PATENT DOCUMENTS 5,477,434 A * 12/1995 Reed ..... 362/119
5,826,968 A * 10/1998 Brantley et al. ..... 362/119
5,848,832 A * 12/1998 Hsieh ..... 362/119
6,033,081 A * 3/2000 Huang ..... 362/119
6,079,846 A * 6/2000 Huang ..... 362/119
6,183,103 B1 * 2/2001 Hillinger ..... 362/119
6,367,944 B1 * 4/2002 Wang ..... 362/119
6,508,565 B2 * 1/2003 Wang ..... 362/119
6,776,500 B1 * 8/2004 Chen ..... 362/119
2004/0212989 A1 * 10/2004 Chen ..... 362/119

* cited by examiner

*Primary Examiner*—Ismael Negron

(57) ABSTRACT

A driver head, including a body with a connecting end, a control member, a light emitting element and a power supply element; a control member is pivotally installed in the transversal groove of the body; an electrically conducting plate is contained in the conducting groove of the control member; the outer circumferential surface of a light emitting element is in contact with the body; a plurality of power supply elements are installed in the third groove; a resilient element is installed in the third groove; the control member has a conducting groove, such that the electrically conducting plate can be installed in the conducting groove, and the control member can be turned to drive the electrically conducting plate or the control plane to contact the power supply element, for controlling an electric connection.

7 Claims, 9 Drawing Sheets

ILLUMINATED DRIVER HEAD WITH CONTROL MEMBER

BACKGROUND OF THE INVENTION

1. Field of the Invention

The present invention relates to a driver head with a lamplight for providing an illumination and screwing other components.

2. Description of the Related Art

Referring to FIGS. 3 to 5 and U.S. Pat. No. 6,183,103, a body 22 includes a transverse passageway 44, and a switch element 42 made of an electrically conducting material and contained in a passageway 44 of the body 22 and movable to left and right sides, and the switch element 42 includes two dispositions 6068 for connecting an insulator ring 7072. However, the structure of such patented invention has the following drawback:

1. If there is a screw component on a hole, the body 22 may not be put into a smaller hole diameter and connected to a bushing to rotate the screw component.

2. Both ends of the switch element 42 are protruded and exposed from the outer circumferential surface of the body 22, such that when the body 22 is rotated, the body 22 will hit other components easily, and the switch element 42 will be collided easily and shifted to another position automatically.

SUMMARY OF THE INVENTION

A driver head, comprising: a body, a control member, a light emitting element and a power supply element, wherein an end of said body is a connecting end; a control member is pivotally installed in said transversal groove of said body; an electrically conducting plate is contained in said conducting groove of said control member; the outer circumferential surface of a light emitting element is in contact with said body; a plurality of power supply elements are installed in said third groove; a resilient element is installed in said third groove; said control member has a conducting groove, such that said electrically conducting plate can be installed in said conducting groove, and said control member can be turned to drive said electrically conducting plate or said control plane to contact said power supply element, for controlling an electric connection.

DETAILED DESCRIPTION OF THE PREFERRED EMBODIMENTS

Figure 1:
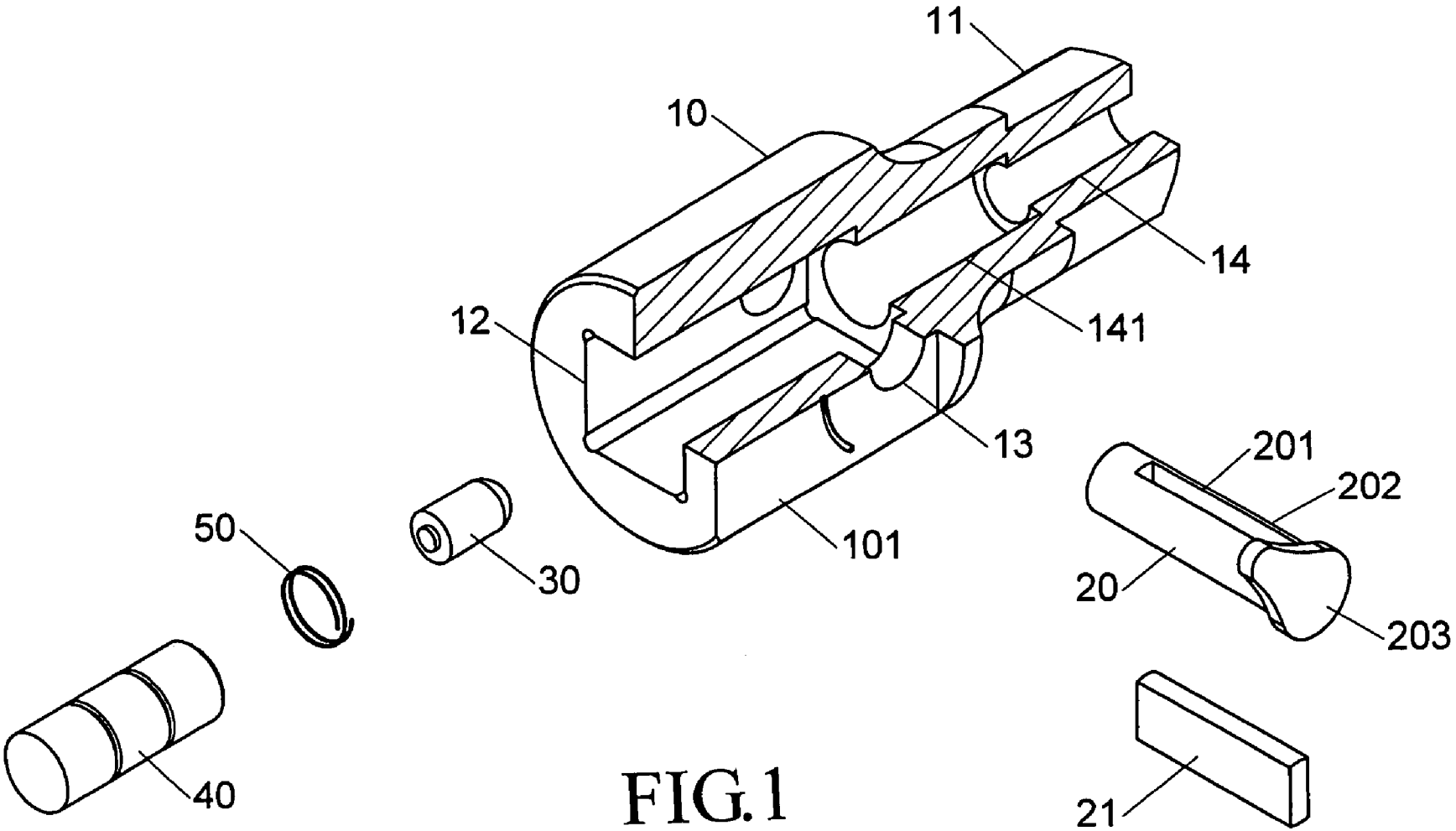
FIG. 1 is an exploded view of a first embodiment.
Figure 2:
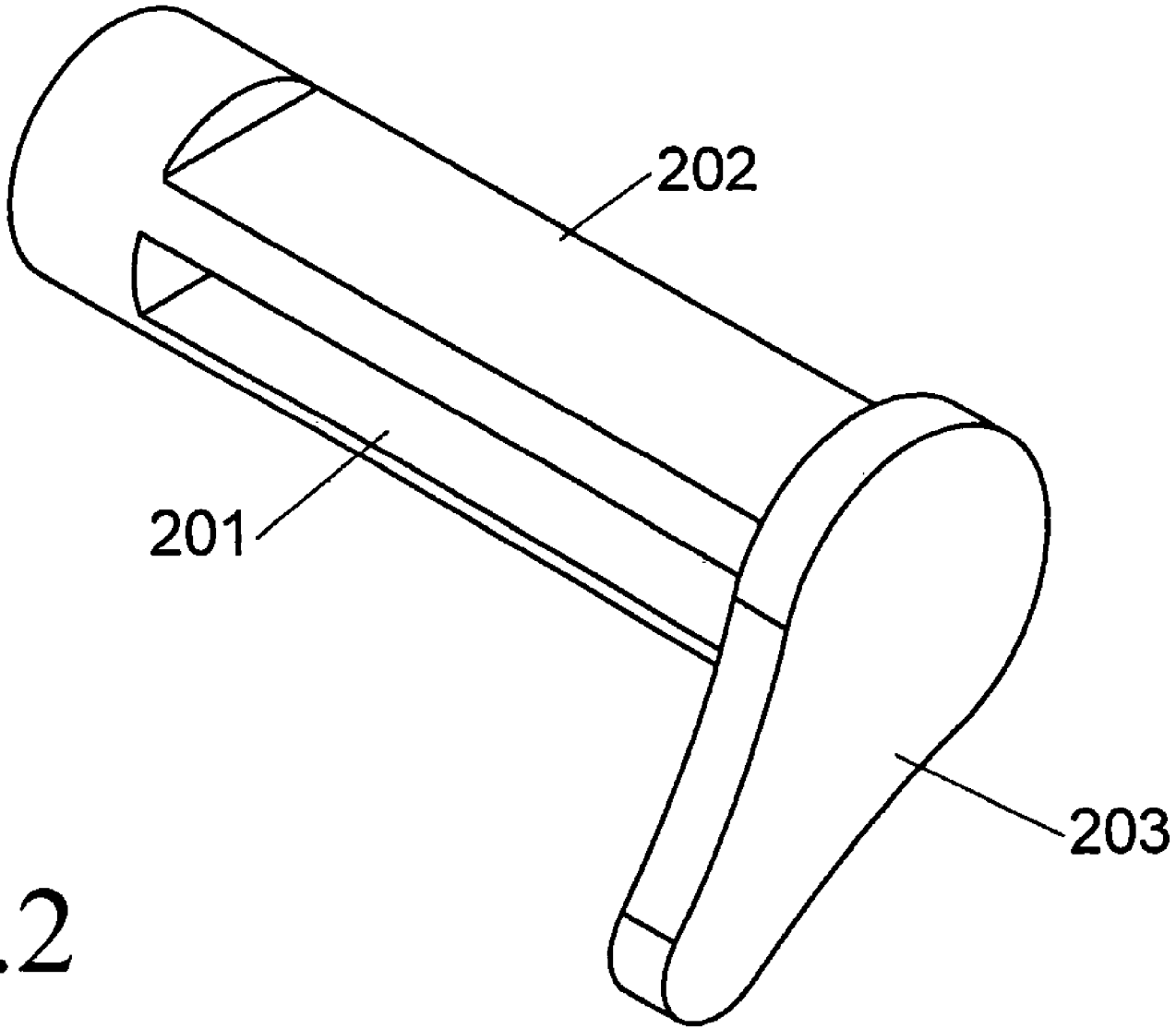
FIG. 2 is a perspective view of a switch.

Referring to FIGS. 1 and 2, a driver head comprises: a body 10, a control member 20, a light emitting element 30, a power supply element 40 and a resilient element 50.

The body 10 is a general driver head made of an electrically conducting metal, and an end of the body 10 is a connecting end 11 and sequentially includes a first groove 12, a third groove 141 and a second groove 14, and the second groove 14 is disposed in the connecting end 11, and the first groove 12, third groove 141 and second groove 14 are interconnected, and the outer circumferential surface of the first groove 12 of the body 10 has a plane 101, a transversal groove 13 disposed transversally and interconnected to the first groove 12 and the plane.

The control member 20 is made of an insulating material and the control member 20 is pivotally coupled into the transversal groove 13 of the body 10, and a narrow groove shaped conducting groove 201 is disposed at a corresponding position of the first groove 12, and a plane 202 is disposed on an outer circumferential surface, and an end has a poking chunk 203 protruded and exposed from the plane 101 of the body 10 for facilitate a user to poke the poking chunk 203 by a hand, so that the control member 20 can rotate to an appropriate angle.

The electrically conducting plate 21 is disposed in the conducting groove 201 of the control member 20 and the length of the electrically conducting plate 21 is greater than the width of the first groove 12, such that two rear sides can touch the body 10 after the electrically conducting plate 21 is turned, and can be aligned with the outer circumferential surface of the control member 20 after the electrically conducting plate 21 is put in.

The light emitting element 30 is a light emitting diode (LED) or other light emitting component, and the light emitting element 30 is installed in the second groove 14 of the body 10, and the outer circumferential surface of the light emitting element 30 is in contact with the body 10.

The power supply elements 40 come with a plurality and are installed in the third groove 141, and the power supply element 40 is slightly in contact with the light emitting element 30, such that the power supply element 40 can supply an electric power. When the poking chunk 203 of the control member 20 is turned, the electrically conducting plate 21 or the control plane 202 of the conducting groove 201 can be contacted or disconnected with the power supply element 40 to form a circuit.

The resilient element 50 is an electrically conducting metal spring installed in the third groove 141, and an end of the resilient element 50 pressed on the light emitting element 30, and the other end of the resilient element 50 presses on the power supply element 40.

Figure 3:
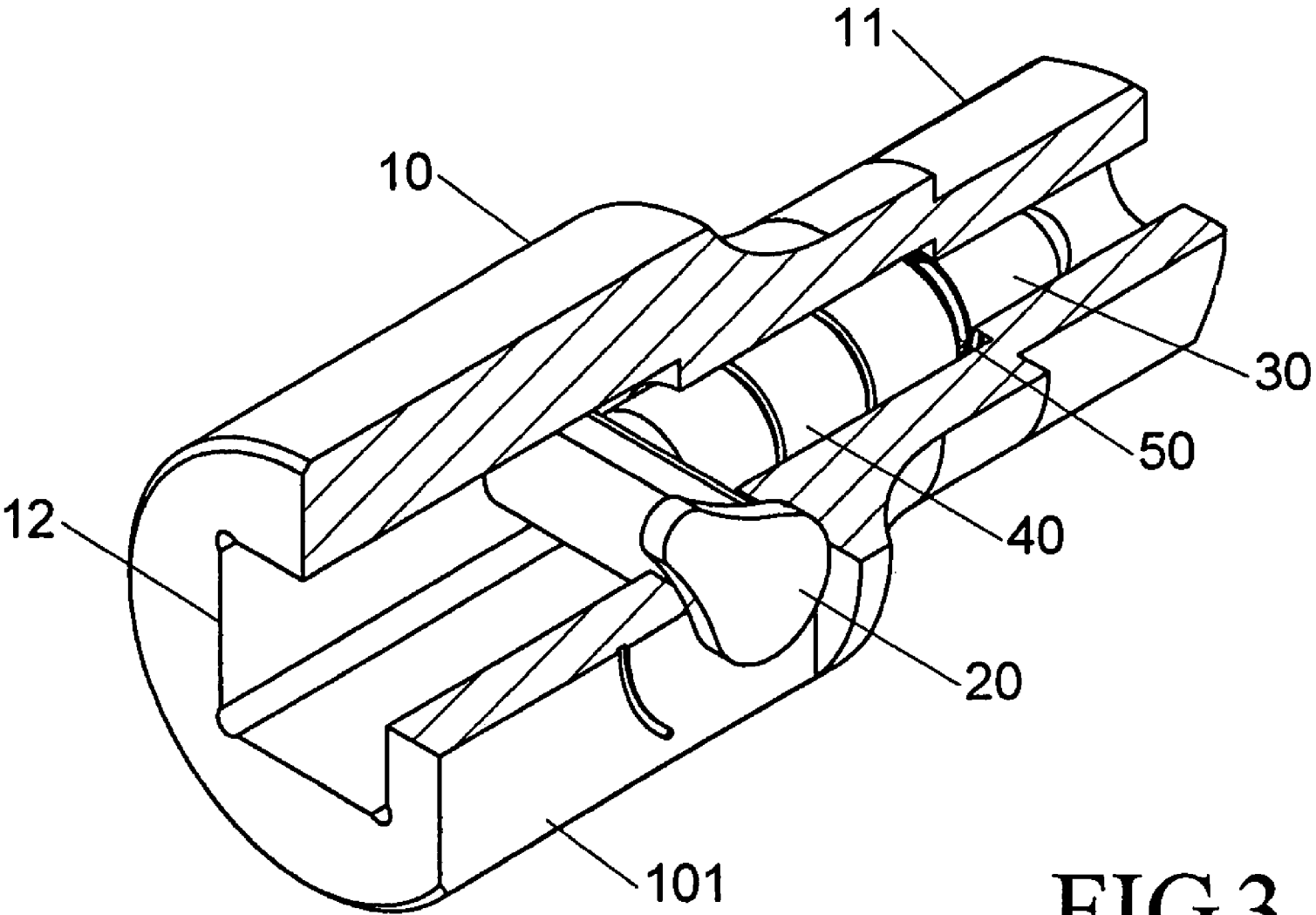
FIG. 3 is a semi-sectional view of a first embodiment.
Figure 4:
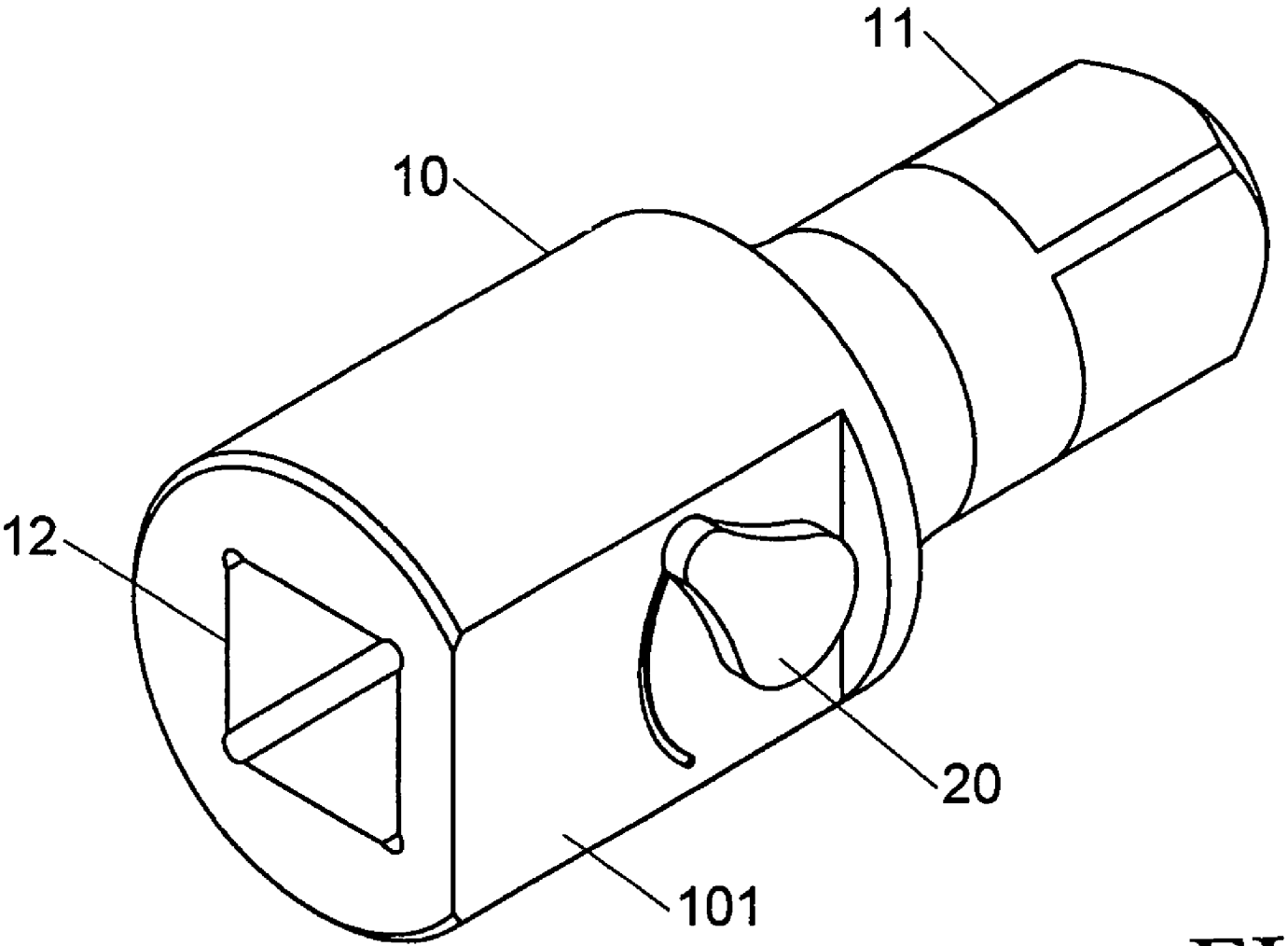
FIG. 4 is a perspective view of a first embodiment.

In FIGS. 1 and 2, the light emitting element 30 is installed in the second groove 14 of the body 10 and then installed in the resilient element 50, and the power supply element 40 is installed in the third groove 141, and the conducting groove 201 of the control member 20 is installed in the electrically conducting plate 21, and then the control member 20 is contained in the transversal groove 13, and the plane 202 of the control member 20 presses at an end of the power supply element 40 and the light emitting element 30, and the resilient element 50 and the power supply element 40 will be aligned linearly, and the poking chunk 203 is protruded and exposed from the plane 101 of the body 10. After the assembling is completed, plane 101, the semi-sectional view of the driver head is shown in both FIGS. 3 and 4.

Figure 5:
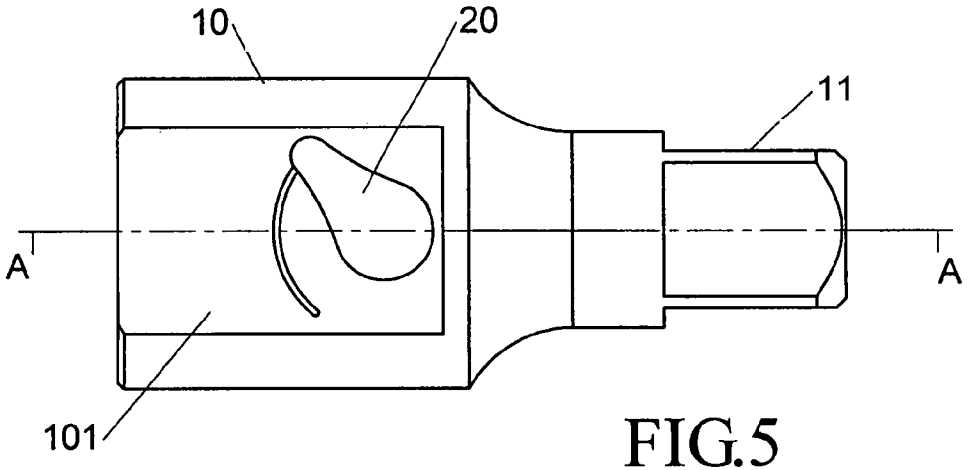
FIG. 5 is a side view of a first embodiment.
Figure 6:
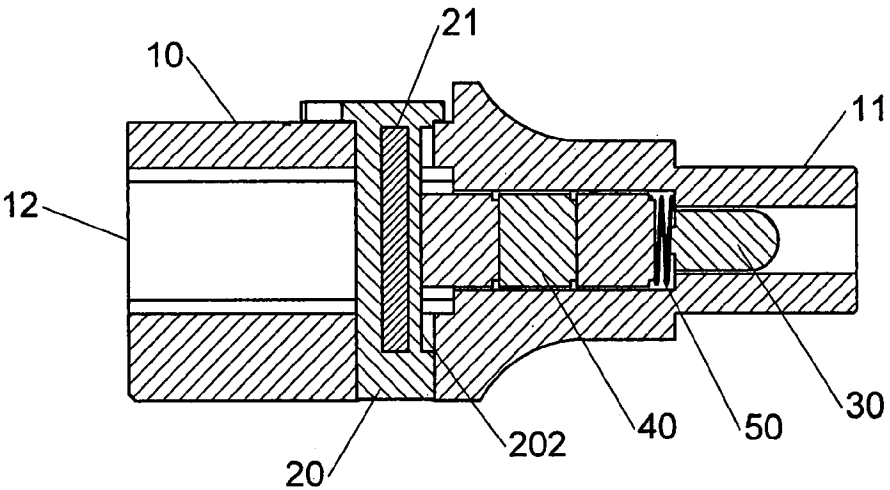
FIG. 6 is a cross-sectional view of section A-A of FIG. 5.

In FIGS. 5 and 6, when the poking chunk 203 of the control member 20 faces towards the plane 101, the control member 20 in the transversal groove 13 controls the plane 202 to press the power supply element 40, such that the control member 20 controls the plane 202 to be electrically disconnected, and the power supply element 40 cannot be in contact with the body 10, and the light emitting element 30 cannot have a light emitting effect.

Figure 7:
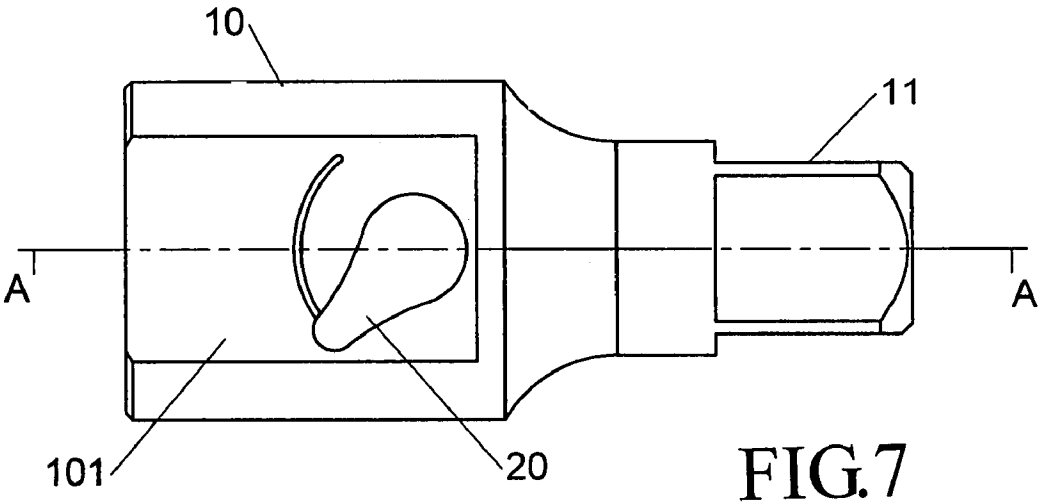
FIG. 7 is a rear side view of the operation of a first embodiment.
Figure 8:
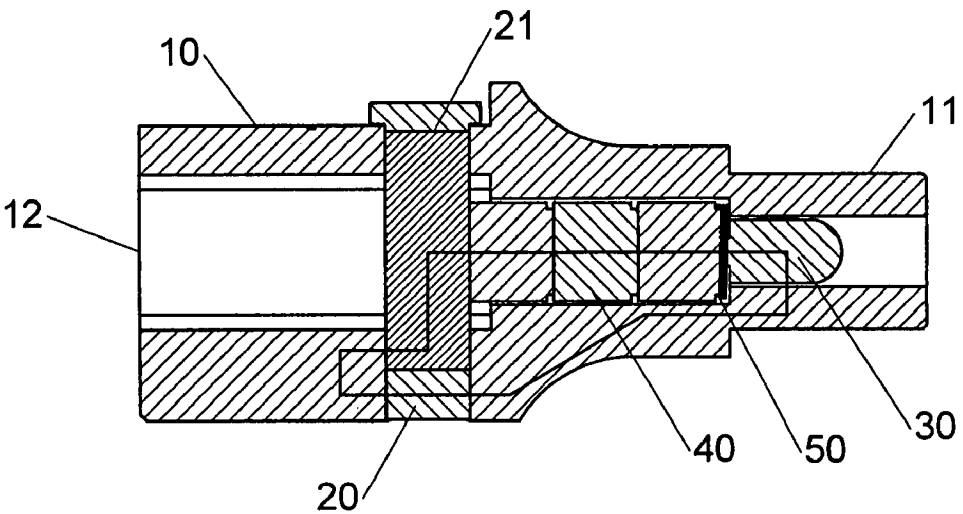
FIG. 8 is a perspective view of section A-A of FIG. 7.

In FIGS. 7 and 8, when the poking chunk 203 is turned, such that the control member 20 is rotated to an angle, and the poking chunk 203 faces the bottom of the plane 101, and the electrically conducting plate 21 of the control member 20 in the transversal groove 13 presses an end of the power supply element 40, such that the electrically conducting plate 21 and the body 10 are in contact with each other through an electrically conducting material, and the circuit allows the light emitting element 30 to have a light emitting effect.

Figure 9:
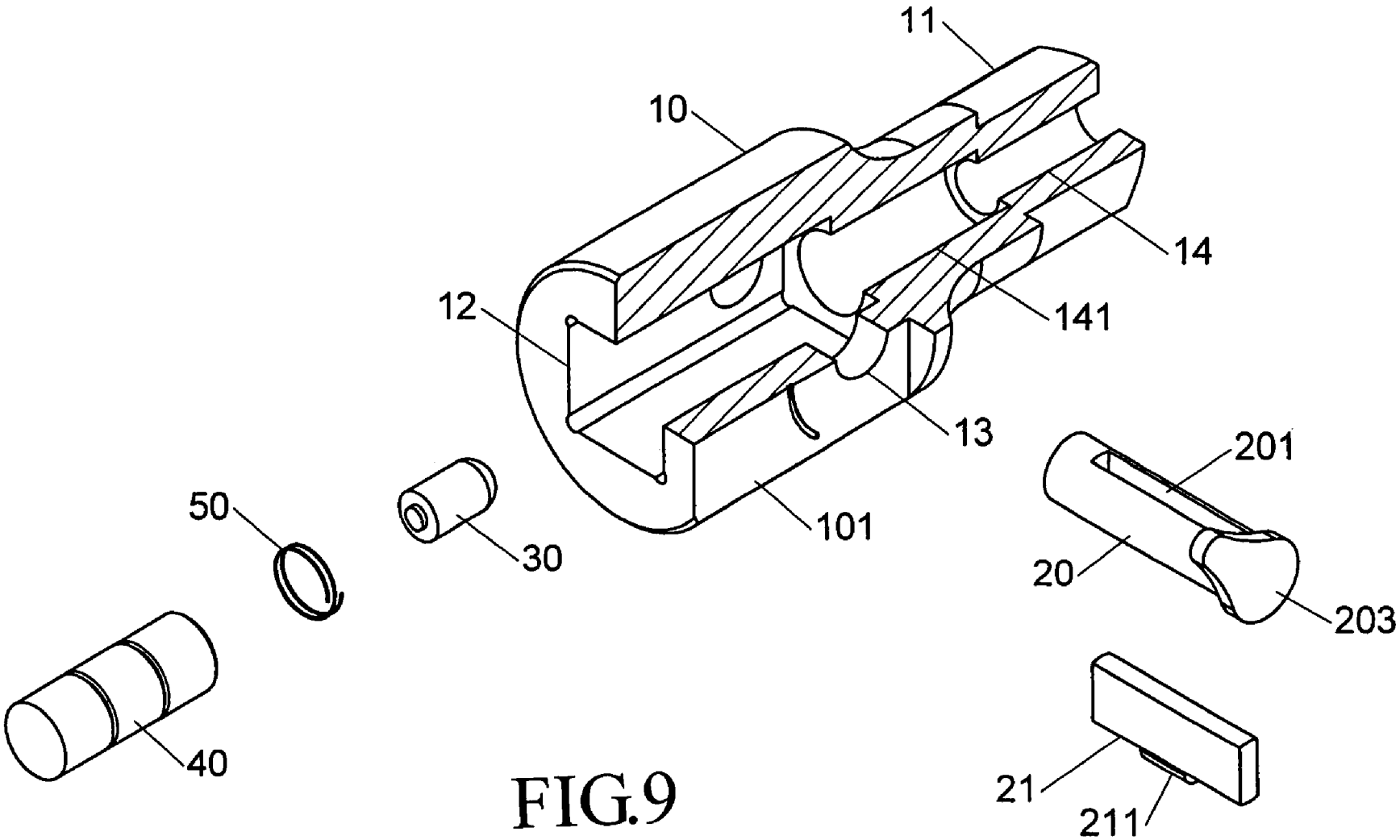
FIG. 9 is an exploded view of a second embodiment.
Figure 10:
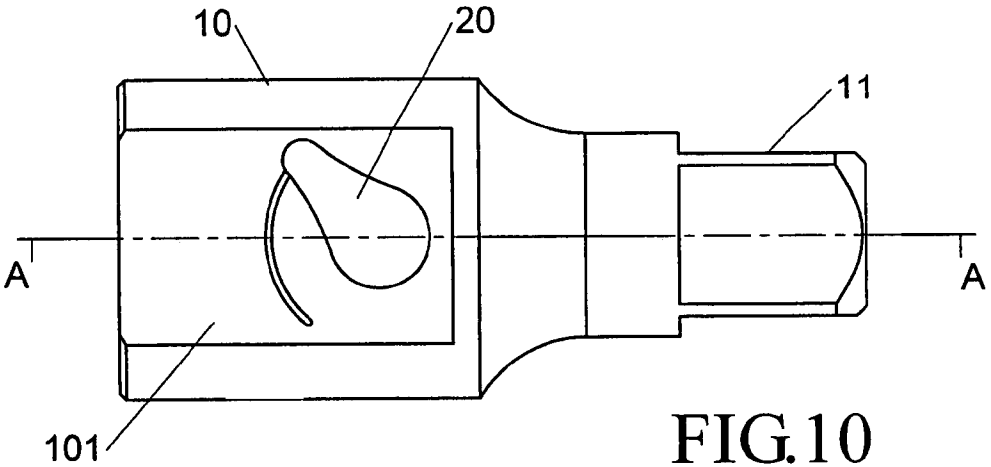
FIG. 10 is a side view of a second embodiment.
Figure 11:
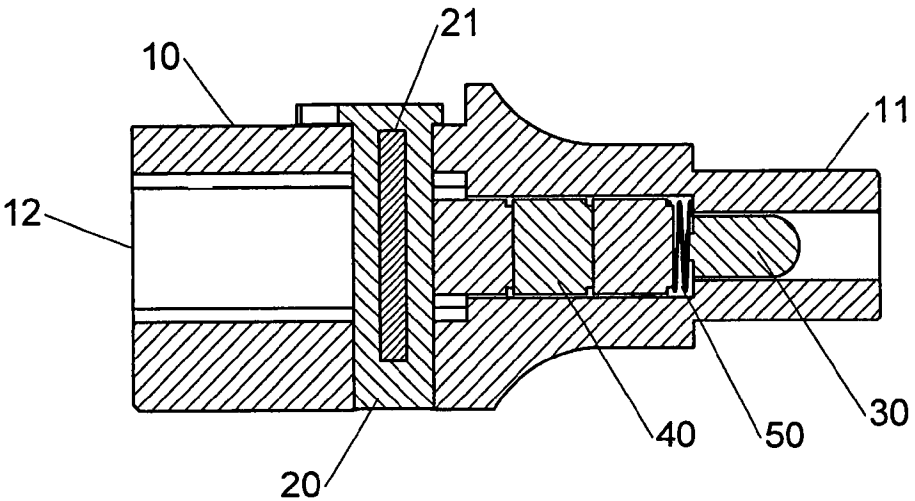
FIG. 11 is a cross-sectional view of section A-A of FIG. 10.

In FIG. 9, the electrically conducting plate 21 includes a protruding chunk 211 protruded from the electrically conducting plate 21, and the control member 20 includes a conducting groove 201, and the electrically conducting plate 21 is contained in the conducting groove 201, and the protruding chunk 211 is protruded from the outer circumferential surface of the control member 20, and the control member 20 installs a poking chunk 203 protruded from the plane 101 of the body 10, and the control member 20 is installed in the transversal groove 13 of the body 10. If the control member 20 is rotated, the outer circumferential surface of the protruding chunk 211 of the control member 20 or the control member 20 itself is in contact with an end of the power supply element 40 to control an electric connection and determine whether or not the light emitting element 30 emits light. In FIGS. 10 and 11, if the poking chunk 203 of the control member 20 faces the top of the plane 101, the outer circumferential surface of the control member 20 will be in contact with an end of the power supply element 40, and thus will not be electrically conducted, and the light emitting element 30 will not emit light.

Figure 12:
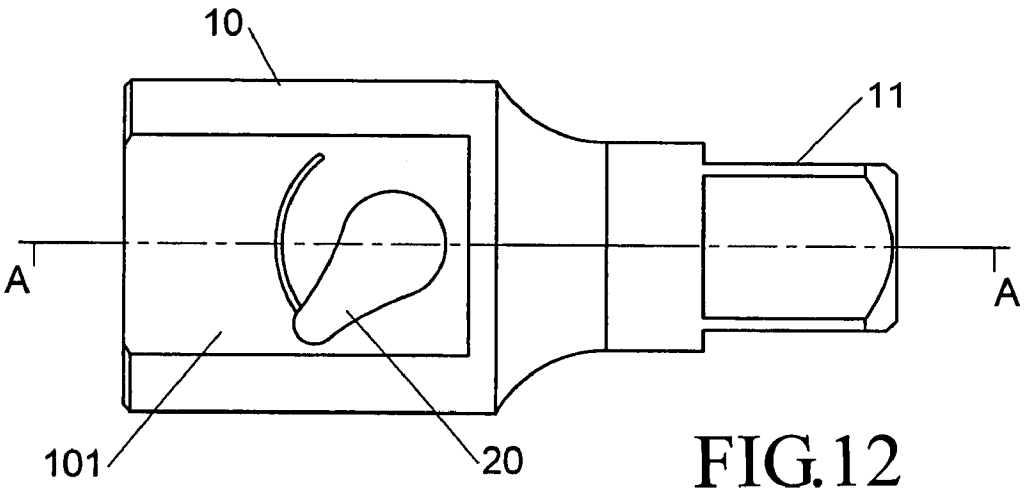
FIG. 12 is a rear side view of the operation of a second embodiment.
Figure 13:
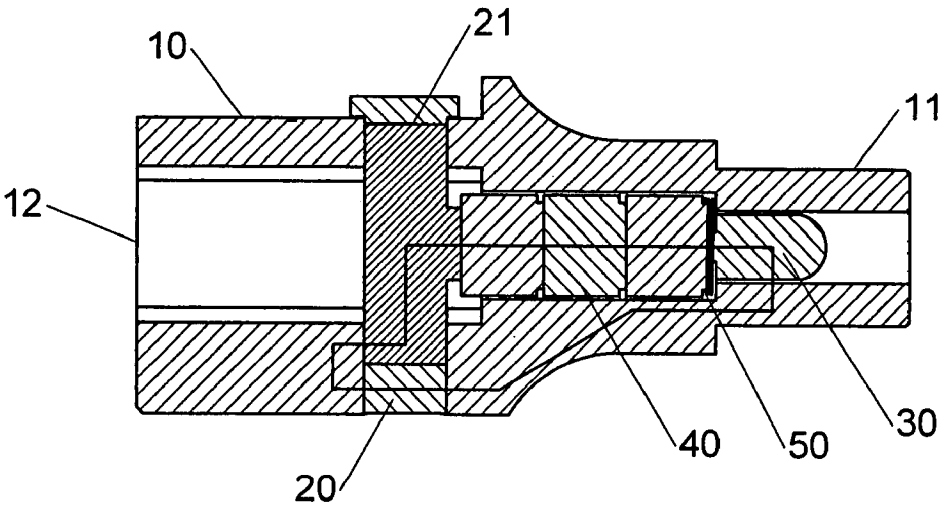
FIG. 13 is a cross-sectional view of section A-A of FIG. 12.

In FIGS. 12 and 13, if the poking chunk 203 faces the bottom of the plane 101, the poking chunk 203 will drive the control member 20 to rotate to an angle. After the protruding chunk 211 of the electrically conducting plate 21 is rotated to press an end of the power supply element 40, an electric connection is produced to allow the light emitting element 30 to emit light.

In another embodiment of the present invention, the body 10 has a third groove 141 with the same diameter of the second groove 14, and the power supply element 40 is contained therein in compliance with the diameter of the third groove 141.

The advantages of the present inventions are listed below:

1. The light emitting effect is adopted to facilitate users to use the driver head in a dark place, and allow users to know and recognize the driver head easily for the screw operation.

2. The control member 20 has a control plane 202, for providing a positioning effect for the structure.

3. During the operation of the driver head, the body 10 will not be hit by other object and thus shifted to other position automatically.

What is claimed is:

1. A driver head, comprising: a body, a control member, a light emitting element and a power supply element, wherein an end of said body is a connecting end, and said body sequentially includes a first groove, a third groove and a second groove, and said second groove is disposed in said connecting end, and said first groove, said third groove and said second groove are interconnected, and said first groove of said body has a plane at an outer circumferential surface, and the transversal position of said body includes a transversal groove interconnected with said first groove and said plane; a control member is pivotally installed in said transversal groove of said body and has a conducting groove corresponding to said first groove and a poking chunk disposed at an end and protruded from said plane of said body plane; an electrically conducting plate is contained in said conducting groove of said control member, and the length of said electrically conducting plate is greater than the width of said first groove, and structurally said control member includes an electrically conducting plate and a control plane; the outer circumferential surface of a light emitting element is in contact with said body; a plurality of power supply elements are installed in said third groove and slightly in contact with said light emitting element, such that said power supply element supplies an electric power and said light emitting element has a light emitting effect, and if said control member poking chunk is turned, said electrically conducting plate or said control plane in said conducting groove will be connect or disconnect said power supply element to form a circuit; a resilient element is installed in said third groove, and an end of said resilient element presses on said light emitting element and another end of said resilient element presses on said power supply element; said control member has a conducting groove, such that said electrically conducting plate can be installed in said conducting groove, and said control member can be turned to drive said electrically conducting plate or said control plane to contact said power supply element, for controlling an electric connection.

2. The driver head in accordance with claim 1, wherein said control member is made of a non-metal substance.

3. The driver head in accordance with claim 1, wherein said poking chunk has a function of facilitating said poking chunk to be poked by a user's hand.

4. The driver head in accordance with claim 1, wherein said light emitting element is an LED.

5. The driver head in accordance with claim 1, wherein said power supply elements are batteries that come with a quantity of two or more.

6. The driver head in accordance with claim 1, wherein said resilient element is an electrically conducting metal spring.

7. The driver head in accordance with claim 1, wherein said body has a third groove with the same diameter of said second groove.

* * * * *